US012751589B2

(12) United States Patent
Xia et al.

(10) Patent No.: US 12,751,589 B2
(45) Date of Patent: Oct. 6, 2026

(54) DEBRIS BIN

(71) Applicant: SHENZHEN SILVER STAR INTELLIGENT GROUP CO., LTD., Shenzhen (CN)

(72) Inventors: Xiaoxiao Xia, Shenzhen (CN); Lirong Ye, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 299 days.

(21) Appl. No.: 17/901,188

(22) Filed: Sep. 1, 2022

(65) Prior Publication Data

US 2023/0200606 A1 Jun. 29, 2023

(30) Foreign Application Priority Data

Dec. 28, 2021 (CN) ..... 202111630698.1

(51) Int. Cl.
*A47L 9/14* (2006.01)
*A47L 9/00* (2006.01)
*A47L 9/32* (2006.01)

(52) U.S. Cl.
CPC ..... *A47L 9/1409* (2013.01); *A47L 9/0027* (2013.01); *A47L 9/149* (2013.01); *A47L 9/32* (2013.01)

(58) Field of Classification Search
CPC ..... A47L 2201/024; A47L 9/1409; A47L 11/4013
See application file for complete search history.

(56) References Cited

U.S. PATENT DOCUMENTS

2006/0288519 A1* 12/2006 Jaworski ..... A47L 11/33 15/340.1
2012/0291809 A1* 11/2012 Kuhe ..... A47L 11/33 134/18
2018/0177367 A1* 6/2018 Amaral ..... A47L 9/106
2020/0022553 A1* 1/2020 Gill ..... A47L 9/1436
2020/0359868 A1* 11/2020 Bo ..... A47L 9/1683
2021/0059495 A1* 3/2021 Gill ..... A47L 9/102
(Continued)

FOREIGN PATENT DOCUMENTS

CN 111449574 A 7/2020
CN 214259224 U 9/2021
(Continued)

OTHER PUBLICATIONS

Search Report mailed to Corresponding Chinese Patent Application No. 2021116306981 dated Nov. 4, 2025 with English Translation.

*Primary Examiner* — Bryan R Muller
(74) *Attorney, Agent, or Firm* — The Sun IP Law

(57) ABSTRACT

A debris bin includes a box body, a debris suction opening, and a debris outlet opening. The box body has an inner cavity. The debris suction opening is defined on the box body and communicates with the inner cavity of the box body. The debris outlet opening is defined on the box body and communicates with the inner cavity of the box body. The inner cavity is provided with a supporting surface for supporting debris. The supporting surface is inclined, and a top edge of the supporting surface and a bottom edge of the supporting surface are arranged parallel to each other and horizontally. The debris outlet opening is located at a side of the bottom edge of the supporting surface.

8 Claims, 3 Drawing Sheets

(56) References Cited

U.S. PATENT DOCUMENTS

| | | | | |
|---|---|---|---|---|
| 2022/0218170 | A1* | 7/2022 | Wang | A47L 11/4013 |
| 2024/0049935 | A1* | 2/2024 | Hou | G05D 1/0255 |

FOREIGN PATENT DOCUMENTS

| | | | |
|---|---|---|---|
| CN | 214434056 | U | 10/2021 |
| CN | 216907787 | U | 7/2022 |
| KR | 20100104792 | A | 9/2010 |

* cited by examiner

DEBRIS BIN

CROSS-REFERENCE TO RELATED APPLICATIONS

This application is based upon and claims priority to Chinese Patent Application CN202111630698.1, filed Dec. 28, 2021, the entire contents of which are incorporated herein by reference.

TECHNICAL FIELD

The present disclosure relates to the technical field of cleaning equipments, and more particularly, to a debris bin.

BACKGROUND

A debris bin is configured to suck debris in through a suction opening under negative pressure, so as to collect the debris. The debris that is sucked into the debris bin will be temporarily stored in the debris bin. The debris finally can be sucked into a debris recovery station through a debris suction channel under negative pressure, so as to recover the debris from the debris bin. However, in the related art, in order to effectively utilize an internal space of the debris bin and enable the debris bin to accommodate more debris, most of the debris bins are provided with a flat bottom. When the debris suction channel is narrow or too long, the debris recovery station fails to suck all the debris, resulting in some debris being left around the debris bin. In hot weather, this debris will smell, resulting in poor user experience and an unsatisfactory debris recovery rate.

SUMMARY

There is provided a debris bin according to embodiments of the present disclosure. The technical solution is as below:

According to a first aspect of embodiments of the present disclosure, there is provided a debris bin, comprising:

a box body, having an inner cavity;

a debris suction opening, defined on the box body and communicated with the inner cavity of the box body; and a debris outlet opening, defined on the box body and communicated with the inner cavity of the box body;

wherein the inner cavity is provided with a supporting surface for supporting debris, wherein the supporting surface is inclined, and the debris outlet opening is located at one side of a bottom edge of the supporting surface.

BRIEF DESCRIPTION OF THE DRAWINGS

In order to illustrate or the technical solutions in the embodiments of the present disclosure more clearly, the drawings that are used in the description of the embodiments or the prior art will be introduced briefly as follows. Obviously, the drawings in the following description are only some embodiments of the present disclosure, for those of ordinary skill in the art, other drawings may also be obtained based on the structures shown in these drawings without creative labor.

DETAILED DESCRIPTION

Figure 1:
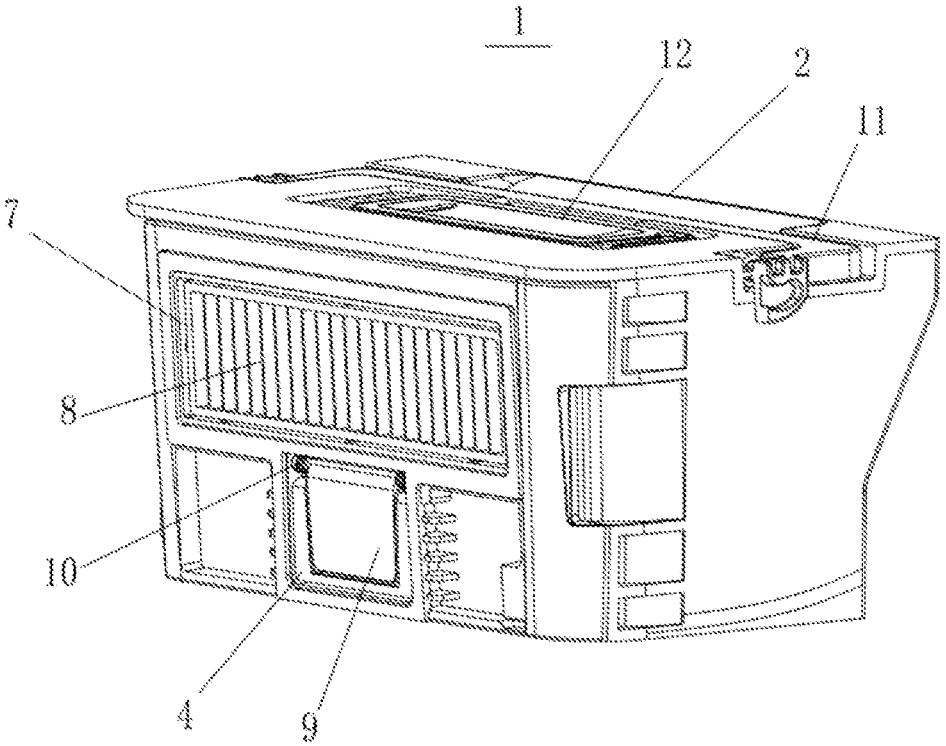
FIG. 1 is a schematic structural view of a debris bin according to an embodiment of the present disclosure.

In order to make the technical problems to be solved by the present disclosure, technical solutions and beneficial effects clearer, the present disclosure will be further described in detail below with reference to the accompanying drawings and embodiments. It should be understood that the specific embodiments described herein are only used to explain the present disclosure, but not to limit the present disclosure.

It should be noted that when one element is referred to as being "fixed to" or "arranged on" the other element, it may be directly on the other element or indirectly on the other element. When one element is referred to as being "connected to" the other element, it may be directly connected to the other element or indirectly connected to the other element.

In addition, the terms "first" and "second" are only used for descriptive purposes, and should not be construed as indicating or implying relative importance or implying the number of indicated technical features. Thus, a feature defined as "first" or "second" may expressly or implicitly include one or more of that feature. In the description of the present disclosure, "plurality" means two or more, unless otherwise expressly and specifically defined. "Several" means one or more than one, unless otherwise expressly specifically defined.

In the description of the present disclosure, it should be understood that the orientation or positional relationship indicated by the terms such as "center", "length", "width", "thickness", "up", "down", "front", "rear", "left", "right", "vertical", "horizontal", "top", "bottom", "inside" and "outside" are based on the orientation or positional relationship shown in the drawings. These items are only for the convenience of describing the present disclosure and simplifying the description, but not to indicate or imply that the indicated device or element must have a particular orientation, be constructed and operate in a particular orientation, and therefore should not be construed as a limitation of the present disclosure.

In the description of the present disclosure, it should be noted that the terms "arrange", "connect" and "joint" should be understood in a broad sense, unless otherwise expressly specified and limited. For example, it may be a fixed connection or a detachable connection, or an integral connection. It may be a mechanical connection or an electrical connection. It may be a direct connection or an indirect connection through an intermediate medium. It may be a internal communication between two elements or an interaction relationship between two elements. For those of ordinary skill in the art, the specific meanings of the above-mentioned terms in the present disclosure can be understood according to specific situations.

Figure 2:
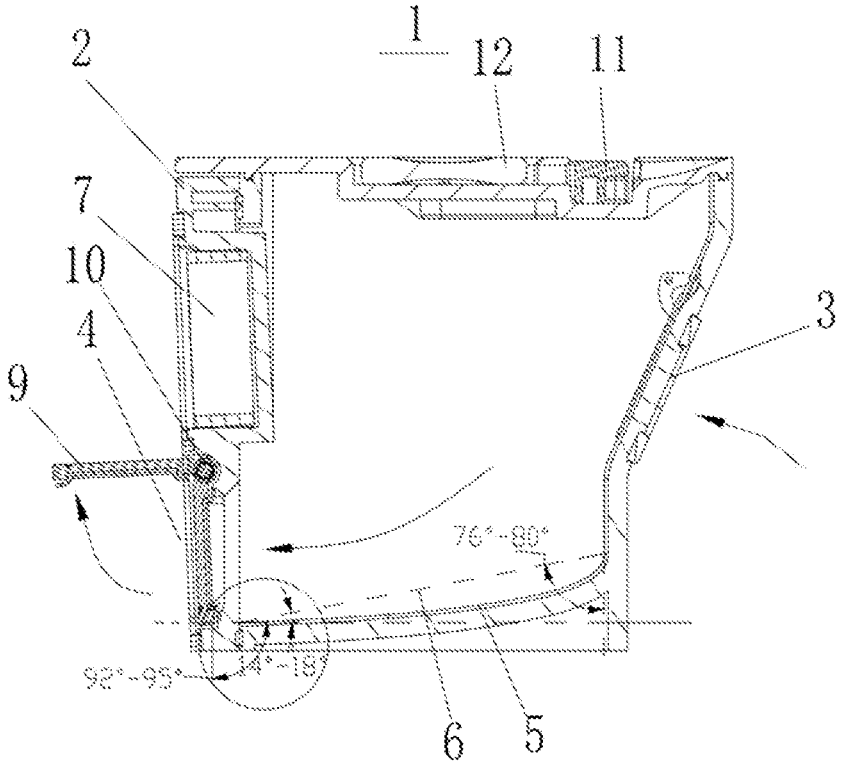
FIG. 2 is a sectional view of FIG. 1.
Figure 3:
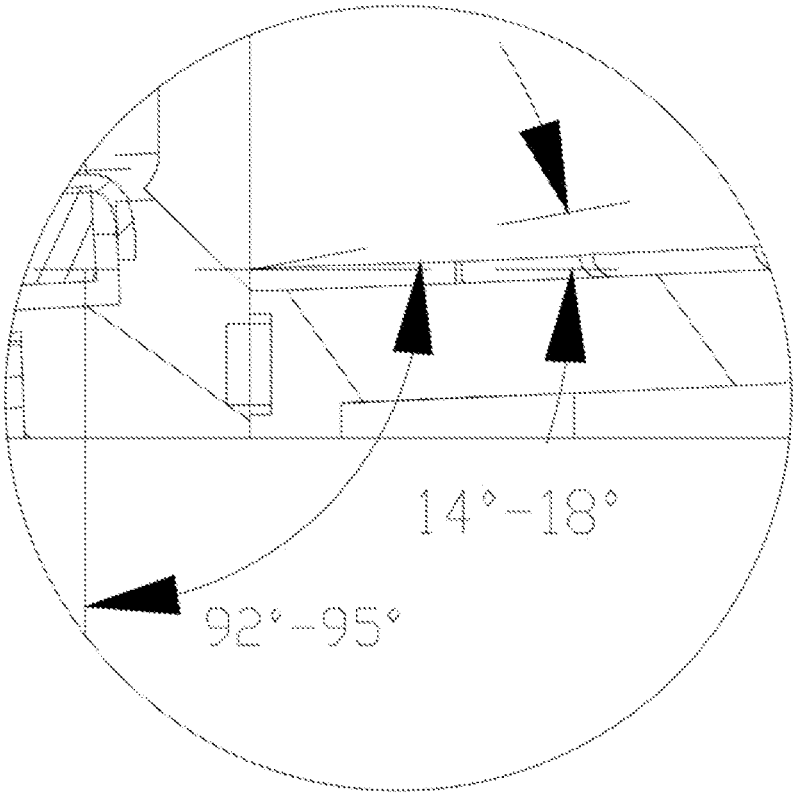
FIG. 3 is a partial enlarged view of FIG. 2.

Referring to FIGS. 1-3, the present disclosure provides a specific embodiment of a debris bin 1, including a box body 2, a debris suction opening 3, and a debris outlet opening 4.

In this embodiment, the box body 2 has an inner cavity, and the inner cavity of the box body 2 is configured to accommodate debris. The shape of the box body 2 may be in a form of a cuboid, a cube, a cylinder, a sphere, or an irregular shape. The shape of the box body 2 is not limited in this embodiment, as long as the box body 2 has an inner cavity capable of accommodating debris. The material of the box body 2 may be plastic. In addition, other functional accessories may be provided on the surface of the box body 2, such as a handle 11 and a cleaning brush 12.

A cavity wall of the inner cavity of the box body 2 may be a smooth surface, so that the debris will not be adhered to the cavity wall of the box body 2 when the debris enters the inner cavity. If the box body 2 is made of plastic, the cavity wall of the box body 2 cannot be provided with patterns that can increase friction. In order to facilitate the cleaning of the inner cavity of the box body 2, the box body 2 may include a box cover. The box cover is covered on the box body 2 and is detachably connected to the box body 2, and the inner cavity is sealed after the two are connected. The handle 11 may be arranged on the box cover. The cleaning brush 12 may also be arranged on the box cover, and a groove with the same shape as the handle 11 may be provided on the box cover, so that the handle 11 is placed in the groove when not in use. The cleaning brush 12 may also be provided in the same manner.

The debris suction opening 3 is defined on the box body 2, and the debris suction opening 3 is defined on the side wall of the box body 2, which communicates with the inner cavity of the box body 2, and is configured to suck the debris from the debris suction opening 3 and enter the box body 2. Specifically, the debris bin 1 is connected to a negative pressure mechanism, which can generate a negative pressure inside the box body 2, so that the debris can enter from the debris suction opening 3. The shape and size of the debris suction opening 3 may be set according to requirements, or may be set correspondingly according to a volume of the box body 2.

The shape of the debris suction opening 3 may be circular, rectangular or other irregular shapes. However, in order to provide sufficient adsorption capacity, the debris suction opening 3 should not be set too large, so as not to affect the suction effect under negative pressure. In some embodiments, it may be in a relatively oblong shape, which is convenient for suction.

The debris outlet opening 4 is also defined on the box body 2, and its function is that when the debris in the debris bin 1 reaches a certain amount, the debris will flow out from the debris outlet opening 4 and enter the debris recovery station, so that the debris can be recycled. Specifically, the debris may be sucked out from the debris outlet opening 4 by the power assembly, and the power assembly may be a fan. A baffle may be arranged at the debris outlet opening 4. Under normal conditions, the baffle is in a closed position. When the debris needs to be sucked away, the baffle is in an open position.

It should be noted that the debris suction opening 3 and the debris outlet opening 4 are located on two opposite side walls of the box body 2, so that the debris can enter from the debris suction opening 3 on one side and is sucked away from the debris outlet opening 4 on the other side, thereby that it will not cause the debris to have a large turning angle, which is convenient for the outflow of debris.

It should be noted that the negative pressure mechanism that sucks the debris from the debris suction opening 3 and the power assembly that sucks the debris out of the debris outlet opening 4 are not a set of systems. The two operate independently because the debris needs to be temporarily stored in the inner cavity. If the two are set in a system, the debris will be sucked in and sucked out at the same time, and the debris bin 1 will be ineffective.

Since there is a technical problem that some debris may remain when the debris bin 1 works to suck away the debris, in order to realize that when the debris flows out of the debris outlet opening 4, there will be no more residues in the debris bin 1, and the debris can be sucked away. Therefore, in this embodiment, an inclined supporting surface 5 is provided inside the debris bin 1. Since the supporting surface 5 is inclined, the debris entering into the debris bin 1 from the debris suction opening 3 will converge. Since the debris outlet opening 4 is located on the lower side of the inclined surface, the debris is gathered at the debris outlet opening 4, so that the debris can be sucked away well, thereby improving the recycling rate of the debris recovery station.

Specifically, in this embodiment, the debris suction opening 3 and the debris outlet opening 4 are respectively located on both sides of the box body 2 of the debris bin 1. The debris suction opening 3 is located at a higher place, and the debris outlet opening 4 is located at a lower place, so the supporting surface 5 arranged in the debris bin 1 is inclined. A higher end of the supporting surface 5 is close to the debris suction opening 3, and a lower end is close to the debris outlet opening 4. In this way, when the debris enters from the debris suction opening 3, it slides along the supporting surface 5 to an area close to the debris outlet opening 4, and flows out from the debris outlet opening 4 into the debris recovery station under the suction force of the power assembly.

Therefore, the embodiment has following beneficial effects. The debris bin 1 sucks the debris through the debris suction opening 3. The box body 2 has an inner cavity, and the inner cavity is configured to store the sucked debris. When the debris in the debris bin 1 needs to be processed, it will be sucked out again through the debris outlet opening 4, and enters the debris recovery station after being sucked out. In order to fully suck the debris in the debris bin 1, the debris bin 1 provided by the present disclosure adopts the following technical solution. A supporting surface 5 is arranged in the inner cavity to support the sucked debris, and the supporting surface 5 is inclined. The debris entering the debris bin 1 will be gathered to a lower position under a slope action, and the debris outlet opening 4 is located at one side of a bottom edge of the supporting surface 5, so that the debris will gather near the debris outlet opening 4, which is easy to be sucked away. Therefore, the debris in the debris bin 1 can be cleaned up without leaving any residue.

As an implementation of the debris bin provided in this embodiment, the setting of the supporting surface 5 needs to meet the practice conditions, so that the best convergence effect can be achieved without affecting the space inside the debris bin 1 for accommodating debris. A top edge of the supporting surface 5 and a bottom edge of the supporting surface 5 are parallel to each other and are arranged horizontally. An included angle between a plane where the top edge and the bottom edge are located and a vertical plane is 76°-80° or the included angle between the plane where the top edge and the bottom edge are located and a horizontal plane is 14°-18°.

It should be noted that since the supporting surface 5 is provided in the debris bin 1, a space size of the debris bin 1 may be affected, thereby reducing an accommodating capacity of the debris in the debris bin 1. In order not to affect the accommodating capacity of the debris as much as possible, in this embodiment, the top edge of the supporting surface 5 and the bottom edge of the supporting surface 5 are parallel to each other and are arranged horizontally, and the included angle between a plane where the top edge and the bottom edge are located and a vertical plane is 76°-80° or the included angle between the plane where the top edge and the bottom edge are located and a horizontal plane is 14°-18°.

Specifically, in this embodiment, the plane where the top edge and the bottom edge that are parallel and horizontally located is defined as a first plane 6. Therefore, in this embodiment, optionally, the included angle between the first plane 6 and the vertical plane is 76°-80°. Optionally, the included angle between the first plane 6 and the horizontal plane is 14°-18°. In this embodiment, only one of the two conditions needs to be satisfied. Under this condition, a good convergence effect is achieved. When the debris falls on the supporting surface 5, it will slide to the area close to the debris outlet opening 4. Besides, the supporting surface 5 with this angle will not take up too much space of the debris bin 1.

For example, the included angle is not within this angle range. In one case, if the supporting surface 5 is too flat, it will not occupy a lot of space in the debris bin 1, but the supporting surface 5 has no obvious convergence effect of debris. In another case, if the supporting surface 5 is too steep, it will occupy a large space. Although the debris can be gathered quickly, it will reduce the accommodating space of the debris bin 1, which is not desirable.

Specifically, optionally, the included angle between the first plane 6 and the vertical plane is 76°, and the included angle between the first plane 6 and the horizontal plane is 14°. Optionally, the included angle between the first plane 6 and the vertical plane is 80°, and the included angle between the first plane 6 and the horizontal plane is 10°. Optionally, the included angle between the first plane 6 and the horizontal plane is 18°, and the included angle between the first plane 6 and the vertical plane is 72°.

Under the condition that the angle is satisfied as above, a good convergence effect can be achieved without taking up too much space in the inner cavity. In the specific setting, the top edge of the supporting surface 5 may be connected to the lower edge of the debris suction opening 3, and the bottom edge of the supporting surface 5 may be connected to the lower edge of the debris outlet opening 4, so as to achieve a better convergence effect.

It should be noted that the supporting surface 5 in the present disclosure is not limited to a flat surface, it may be in the form of an arc surface or the like, and the arc surface may also be inclined. When the supporting surface is inclined and the inclined angle is within the above-mentioned angle range of the present application, it falls within the protection scope of the present disclosure.

Therefore, the beneficial effect brought by this embodiment is as follows. Since the supporting surface 5 is inclined in the inner cavity, the included angle between the plane where the top edge and the bottom edge of the supporting surface 5 are located and the vertical plane is 76°-80° or the included angle between the plane where the top edge and the bottom edge are located and the horizontal plane is 14°-18°, in order to achieve the convergence of the debris, but not to affect the overall space of the inner cavity as much as possible. The supporting surface with this angle not only can achieve a better convergence effect, but also affects the overall space size of the inner cavity and the amount of debris as small as possible.

Referring to FIG. 2 and FIG. 3, this embodiment further provides a implementation of the supporting surface 5, that is, the supporting surface 5 is an arc surface concave below the plane where the top edge and the bottom edge are located.

Specifically, the supporting surface 5 is an arc surface concave below the plane where the top edge and the bottom edge are located. Since the above-mentioned plane where the top edge and the bottom edge are located is the first plane 6, in this embodiment, the supporting surface 5 is located below the first plane 6, and it is an arc surface that is concaved downward. Since it is concaved downward instead of protruding upward, the supporting surface 5 can have a better convergence effect.

In this embodiment, the supporting surface 5 adopts a downwardly concave arc surface, which will not affect the convergence effect, when it is within the above-mentioned angle range. The better effect of the downwardly concave arc surface is to further increase the usable space of the debris bin 1, and occupy smaller space in the inner cavity space of the debris bin 1, because the arc surface is concaved downward, and the concave surface provides a certain avoidance space for the debris bin 1.

Therefore, the embodiment further enhances an effect of occupying the space of the debris bin 1 as small as possible without affecting the convergence effect. It should be noted that an arc-shaped surface that protrudes upward cannot be used, because it takes up more space and has a poor convergence effect.

Therefore, it can be seen that the supporting surface 5 of the present disclosure needs to be arranged below the above-mentioned first plane 6 or is overlapped with the first plane 6. When it is overlapped with the first plane 6, the supporting surface 5 is a plane. When it is located below the first plane 6, the first plane 6 is an imaginary virtual plane.

Therefore, the supporting surface 5 needs to meet the above two conditions, that is, the supporting surface 5 is overlapped with the first plane 6 or located below the first plane 6, so that the convergence effect can be achieved. If the supporting surface 5 is located above the first plane 6, it will hinder the debris from sliding, reduce the convergence effect, and also occupy more space, failing to satisfy the usage requirements.

Referring to FIG. 2 and FIG. 3, further, since the supporting surface 5 is a downwardly concave arc surface, the supporting surface 5 extends upward at a certain angle from the bottom edge to the top edge. The supporting surface 5 may be an irregular arc surface, that is, the supporting surface 5 does not extend upwards with a fixed curvature, may be gentle at the beginning and then steeper. An initial included angle between the bottom edge of the supporting surface 5 inclined upward and the horizontal plane is 2°-5°, that is, the supporting surface 5 extends upward at the initial included angle of 2°-5°.

When the supporting surface 5 is a plane, an upward extension angle of the supporting surface 5 is fixed, that is, the included angle between the first plane 6 and the horizontal plane is fixed. Since the supporting surface 5 is overlapped with the first plane 6, the inclined angle is fixed. In this embodiment, the supporting surface 5 is a downwardly concave arc surface, the included angle between the bottom of the supporting surface 5 and the horizontal plane is 2°-5°, and the bottom of the supporting surface 5 extends upward, obliquely. Since the supporting surface 5 is an arc surface, the included angle between the supporting surface 5 and the horizontal plane is variable, and the variation may be uniform. That is, it extends with a fixed curvature, or a non-uniform curvature. In short, when the included angle between the first plane 6 and the horizontal plane is 14°-18° or the included angle between the first plane 6 and the vertical plane is 76°-80°, a good convergence effect can be achieved without taking up too much space.

Optionally, the supporting surface 5 provided in this embodiment may also be plane. When the supporting surface 5 is a plane, the above-mentioned first plane 6 is overlapped with the supporting surface 5, that is, the embodiment in which the supporting surface 5 is a plane is also included within the protection scope of the present application, and the present application is not limited to the arc surface.

Optionally, the supporting surface 5 provided in this embodiment may also be a bending surface, that is, the bottom edge is a starting point, the top edge is an ending point, and the two are connected in a form of a bending surface. The bending surface is formed by connecting two or more planes in a bending manner. The supporting surface 5 may be bended through one bending process or a plurality of bending processes. When the supporting surface 5 is a bending surface that is made by a plurality of bending processes and includes a plurality of sub-surfaces, the sub-surface of the bending surface between the two bending lines may be a plane or an arc surface, and these all are within the protection scope of the present application.

It should be noted that when the supporting surface 5 is a bending surface, the bending surface is also completely located below the first plane 6 and cannot be higher than the first plane 6. When it is a bending surface, the bending surface may be provided with one bend or a plurality of bends, and the plurality of individual surfaces that make up the bending surface also have certain requirements. That is, the setting form of each single surface is consistent with the setting form of the supporting surface 5. Specifically, each single surface needs to satisfy that an included angel between a plane where its bottom edge (an edge connected to a single surface on a lower side) and its top edge (an edge connected to a single surface on an upper side) are located with the vertical surface is 76°-80° or the included angle between the plane with the horizontal plane is 14°-18°. Besides, each single angle satisfies other setting requirements, that is, each single surface can be a scaled-down version of the supporting surface 5, which can achieve a good convergence effect without taking up too much space.

The supporting surface 5 is overlapped with the plane where the top edge and the bottom edge are located or the supporting surface 5 is located below the plane where the top edge and the bottom edge are located. The top edge and the bottom edge are respectively the highest and lowest positions of the supporting face 5.

It should be noted that, regardless of whether the supporting surface 5 adopts an arc surface, a flat surface or a bending surface, the lowest point of the entire supporting surface 5 is the bottom edge, the highest point of the entire supporting surface 5 is the top edge, and a middle part of the supporting surface 5 cannot exceed the lowest point and the highest point. Besides, no matter whether the supporting surface 5 adopts an arc surface or a bending surface, it is below the first plane 6 and cannot be bent or protruded upward beyond the first plane 6. When the supporting surface 5 is a plane, the supporting surface 5 is overlapped with the first plane 6.

Optionally, the supporting surface 5 may be a surface of the bottom of the inner cavity.

In this embodiment, the supporting surface 5 is the surface of the bottom of the inner cavity, which can further increase the space of the inner cavity, because the bottom surface of the inner cavity is the supporting surface 5, which increases the volume for accommodating the debris.

Optionally, an inclined plate may further be provided in the inner cavity, and the supporting surface 5 is a surface of the inclined plate. Whether the supporting surface 5 is the bottom surface of the inner cavity itself or the surface of the inclined plate provided in the inner cavity is within the protection scope of the present application.

The effect of arranging the inclined plate in this embodiment is as follows. The inclined plate may optionally be detachably connected to the cavity wall of the inner cavity, so that the inclined plate is easy to disassemble and clean. After opening the upper cover, the inclined plate can be taken out, and then the debris on the inclined plate can be cleaned up, and finally the inclined plate is put back into the inner cavity, thereby keeping the inner cavity clean.

As shown in FIG. 1, as a embodiment of the debris bin 1 provided in this embodiment, the debris outlet opening 4 is configured to communicate with the debris outlet channel, and the debris outlet channel is connected to the debris recovery station, so that the debris in the inner cavity is sucked into the debris recovery station through the debris outlet channel by the first fan.

In this embodiment, when the debris in the inner cavity of the debris bin 1 needs to be sucked away, the first fan is turned on, and the debris firstly enters the debris outlet channel, and then enters the debris recovery station. The first fan is configured to generate suction force.

As shown in FIG. 1, further, the debris outlet opening 4 is provided with a movable cover 9 unidirectionally opened to one side of the debris outlet channel. An upper end of the movable cover 9 is rotatably connected to a fixed shaft. A torsion spring 10 is arranged between the movable cover 9 and the fixed shaft, which is configured to keep the movable cover 9 in a closed state.

That is, the above-mentioned power assembly includes the first fan, and the first fan is arranged at the debris outlet channel. In this circumstance, in the negative pressure, the first fan is stopped. When the first fan is turned on, the suction force is generated in the debris outlet channel, so that the debris can be sucked away from the debris outlet opening 4.

In this embodiment, only when the first fan is turned on and a negative pressure is generated in the debris outlet channel, the movable cover 9 is opened, and then the debris flows out. In a normal state, under the force of the torsion spring 10, the movable cover 9 is kept in the closed state to prevent the debris from flowing out when the debris outlet channel is not connected.

A cross-sectional shape of the debris outlet channel may be rectangular, circular or other irregular shapes, and a shape of the movable cover 9 is adapted to a shape of the debris outlet opening 4, which can block the entire debris outlet opening 4 when the movable cover 9 is closed. An elastic soft material such as rubber may further be provided on a surface of the movable cover 9 in contact with the debris outlet opening 4, so that the movable cover 9 can maintain a relatively sealed contact with the debris outlet opening 4 under an action of the elastic force. Specifically, a strip-shaped rubber strip may be arranged on one side of the movable cover 9, and a strip-shaped rubber groove may be arranged on one side of the debris outlet opening 4. The rubber strip and the rubber groove are matched, and the rubber strip is arranged in the rubber groove to achieve relatively sealing.

As shown in FIG. 1, further, the debris is sucked away from the debris outlet opening 4 by the suction force of the first fan, while the debris is sucked into the debris bin 1 from the debris suction opening 3 by the suction of a second fan 2. A filter 8 is further provided at the air suction opening 7. The air suction opening 7 is connected to the second fan, and the negative pressure is formed in the box body 2 by the second fan, to make the debris enter the box body 2 from the debris suction opening 3.

The first fan and the second fan are relatively independent and have different functions. When the second fan is turned on to generate the negative pressure in the debris bin 1, the movable cover 9 clings to the debris outlet opening 4, so that the debris suction opening 3 can suck the debris when the debris outlet opening 4 is closed. When the second fan is turned off, the first fan is turned on, and the movable cover 9 is opened, so that the debris is sucked away.

It should be noted that an air suction opening 7 and the debris outlet opening 4 may be located on the same side wall of the box body 2, and both of them are arranged opposite to the debris suction opening 3, which facilitates the entry or outflow of debris when the air is sucked in or out. Since the air suction opening 7 needs to suck a large amount of debris into the inner cavity from different places, the air suction opening 7 may be larger than the debris outlet opening 4, and the power of the second fan is also larger than that of the first fan. Since the second fan is arranged outside the box body 2, a filter 8 is provided at the air suction opening 7 in this embodiment, in order to prevent the debris from being sucked away from the air suction opening 7 after entering from the debris suction opening 3. Therefore, the debris is prevented from being sucked into the air suction opening 7.

Regarding a specific form of the filter 8, it may be composed of a plurality of laminar plates arranged side by side. There is a gap between the adjacent plates, and the gap is configured for the passage of air. The form may also be: the filter 8 is in a shape of a grid, similar to a screen window. The screen window may be an iron screen window.

The movable cover 9 is formed as follows. A groove is arranged on a side wall of the box body 2, and a shape of the groove is adapted to the shape of the movable cover 9. The movable cover 9 is arranged in the groove, which is both beautiful and convenient. Besides, the movable cover 9 is prevented from protruding from the side wall of the box body, which has a good overall structure. The material of the movable cover 9 may be selected to be plastic or metal. Two torsion springs 10 may be provided, which are respectively arranged on both sides of a rotating shaft of the movable cover 9, so that elastic forces generated on both sides are conducive to the balance of strength, and the movable cover 9 can be opened and closed better. It should be noted that the force of the torsion spring 10 may not be set too large, because the movable cover 9 needs to be turned over and opened under the action of suction when the debris needs to be sucked away.

Further, a cleaning brush 12 and a handle 11 are further provided on the box body 2, and the cleaning brush 12 is detachably connected to the box body 2.

In this embodiment, the cleaning brush 12 may be detachably arranged on the box body 2 in a form of snap connection or screw connection, and the cleaning brush 12 may be configured to clean the inside and the outside of the debris bin 1. The debris bin 1 is provided with a top cover, which can be opened when the debris bin 1 needs to be cleaned. A groove structure can be defined on the upper cover, a shape of the groove matches a shape of the handle 11. One end of the handle 11 is rotatably connected to the upper cover. When the handle 11 is not in used, the handle 11 is rotated to be received in the groove.

The cleaning brush 12 may be formed as follows. A groove-shaped structure with an accommodating cavity is provided on an upper cover. The cleaning brush 12 is inserted into the groove-shaped structure. A cover may be set at an opening of the groove-shaped structure. When the cleaning brush 12 is not in used, the cover may cover the opening to prevent it from being polluted. When the cleaning brush 12 is in use, the cover is opened to take out the cleaning brush 12 for operation.

To sum up, the present disclosure has the following beneficial effects. Firstly, the supporting surface 5 is adopted to supporting the debris through its structure, which can smoothly gather the debris to the debris outlet opening 4, which is convenient for suction and keeps the inner cavity clean. Secondly, the supporting surface 5 is provided with a certain inclination angle, which can gather the debris while the inner cavity 3, to the maximum extent, maintains the maximum volume for storing debris. The cleaning brush 12, the handle 11 and other accessories are provided, which is convenient for the use of the debris bin 1.

The debris bin provided by the present disclosure has following beneficial effects. The debris bin sucks the debris through the debris suction opening. The box body has an inner cavity configured to store the sucked debris. When the debris in the debris bin needs to be processed, it will be sucked out through the debris outlet opening, and enters the debris recovery station after being sucked out. In order to fully suck the debris in the debris bin out, the debris bin provided by the present disclosure adopts the following technical solution. A supporting surface is arranged in the inner cavity to supporting the sucked debris, and the supporting surface is inclined. The debris entering the debris bin will be gathered to a lower position under a slope action, and the debris outlet opening is located at one side of a bottom edge of the supporting surface, so that the debris will gather near the debris outlet opening, which is easy to be sucked away. Therefore, the debris bin can be cleaned up without leaving any residue.

It should be noted that, as a embodiment of the present disclosure, since the supporting surface is inclined in the inner cavity, in order not to affect an overall space of the inner cavity as much as possible, and to achieve the effect of gathering debris, an included angle between the plane where the top edge and the bottom edge of the supporting surface are located and the vertical plane is 76°-80° or the included angle between the plane where the top edge and the bottom edge are located and the horizontal plane is 14°-18°. Within this angle, a better convergence effect can be achieved, and the overall space size of the inner cavity and the amount of debris can be affected as little as possible.

Described above are only some embodiments of the present disclosure, and are not intended to limit the scope of the present disclosure. Any modification, equivalent replacement and improvement made within the spirit and principle of the present disclosure should be included within the protection scope of the present disclosure.

What is claimed is:

1. A debris bin, comprising:

a box body, having an inner cavity;

a debris suction opening, defined on the box body and communicating with the inner cavity of the box body; and a debris outlet opening, defined on the box body and communicating with the inner cavity of the box body;

wherein the inner cavity is provided with a supporting surface for supporting debris, wherein the supporting surface is inclined downward from a top edge to a bottom edge when the debris bin is oriented with the supporting surface at a bottom of the debris bin, and the debris outlet opening is located immediately adjacent to at least a portion of the bottom edge of the supporting surface;

wherein the box body is further provided with an air suction opening, wherein the air suction opening and the debris outlet opening are located on and pass through the same side wall of the box body, which is arranged opposite to and spaced from a side wall having the debris suction opening therein;

wherein an included angle in the range of 76°-80° is formed between a first plane passing through the top edge and the bottom edge of the supporting surface and a second plane that is coplanar with the portion of the side wall which is provided with the debris suction opening where the side wall intersects the top edge of the supporting surface, and wherein a filter is provided on a same side of the debris bin as the debris outlet opening, the air suction opening larger than the debris outlet opening and positioned above the debris outlet opening when the debris bin is oriented with the supporting surface at a bottom of the debris bin, and the filter is position within the air suction opening and is also above the debris outlet opening.

2. The debris bin of claim 1, wherein the supporting surface between the top edge and bottom edge is a curved surface concaved downward below the first plane.

3. The debris bin of claim 1, wherein an included angle between the supporting surface immediately adjacent to the bottom edge and a third plane that is coplanar with the side wall having the debris outlet opening and air suction opening therein is 85°-88°.

4. The debris bin of claim 1, wherein the debris outlet opening is provided with a movable cover unidirectionally opened to one side of the debris outlet channel, wherein an upper end of the movable cover is rotatably connected to a fixed shaft, wherein a torsion spring is provided between the movable cover and the fixed shaft, and the torsion spring is configured to keep the movable cover in a closed state.

5. The debris bin of claim 4, wherein a shape of the movable cover is adapted to a shape of the debris outlet opening, which can block the entire debris outlet opening when the movable cover is closed.

6. The debris bin of claim 1, wherein the top edge of the supporting surface is adjacent to the wide wall having the debris suction opening therein.

7. The debris bin of claim 1, wherein the supporting surface is a surface of a bottom of the inner cavity.

8. The debris bin of claim 1, wherein a cleaning brush and a handle are provided on the box body, and wherein the cleaning brush is detachably connected to the box body.

* * * * *